United States Patent [19]

Montgomery et al.

[11] Patent Number: 4,924,606

[45] Date of Patent: May 15, 1990

[54] SPLIT-SOLE SHOE WITH A COMBINED TOE CAP AND FRONT OUTER SOLE

[75] Inventors: Thomas Montgomery, Durham, N.H.; Jeffrey Silverman, Scarsdale, N.Y.

[73] Assignee: Toddler U, Inc., Westport, Conn.

[21] Appl. No.: 265,752

[22] Filed: Nov. 1, 1988

[51] Int. Cl.[5] ..... A43B 13/14

[52] U.S. Cl. ..... 36/31; 36/77 R; 36/102; 36/103

[58] Field of Search ..... 36/31, 69, 72 R, 77 R, 36/88, 90, 102, 103

[56] References Cited

U.S. PATENT DOCUMENTS

| | | | |
|---|---|---|---|
| 159,991 | 2/1875 | White | 36/77 R |
| 195,943 | 10/1877 | Nobs | 36/72 R |
| 351,953 | 11/1886 | Banks | 36/31 |
| 1,162,445 | 11/1915 | Bostock | 36/31 |
| 1,289,711 | 12/1918 | Ettle | 36/31 |
| 1,726,198 | 8/1929 | Stahl | 36/72 R |
| 2,007,728 | 7/1935 | Ranauro | 36/72 |
| 2,192,274 | 3/1940 | Roberts | 12/145 |
| 2,381,503 | 8/1945 | Rette | 36/31 |
| 3,952,429 | 4/1976 | Thomas | 36/31 |
| 3,974,578 | 8/1976 | Oettinger et al. | 36/72 R |
| 4,400,894 | 8/1983 | Ehrlich | 36/31 |
| 4,412,393 | 11/1983 | Terlizzi et al. | 36/77 R |
| 4,506,460 | 3/1985 | Rudy | 36/69 |
| 4,510,702 | 4/1985 | Ehrlich | 36/31 |
| 4,780,970 | 11/1988 | McArthur | 36/72 R |

FOREIGN PATENT DOCUMENTS

| | | | |
|---|---|---|---|
| 660167 | 8/1935 | Fed. Rep. of Germany | 36/72 R |
| 830013 | 1/1952 | Fed. Rep. of Germany | 36/72 R |
| 869227 | 10/1941 | France | 36/31 |
| 1117586 | 5/1956 | France | 36/31 |
| 586696 | 12/1958 | Italy | 36/31 |
| 332115 | 7/1930 | United Kingdom | 36/31 |

*Primary Examiner*—Werner H. Schroeder
*Assistant Examiner*—Diana L. Biefeld
*Attorney, Agent, or Firm*—Lerner, David, Littenberg, Krumholz & Mentlik

[57] ABSTRACT

A split sole shoe has a front outer sole with an outwardly facing recessed section and a heel member with an inwardly facing recessed section, the outwardly facing recessed section being connected to the inwardly facing recessed section in an overlapping configuration so as to form an interior relief groove exposing a portion of the inwardly facing recessed section and an exterior relief groove exposing a portion of the outwardly facing recessed section, thereby increasing the flexibility of the shoe in the region which flexes while taking a heel-to-toe step. A toe cap portion is formed together with the front outer sole so as to provide a smooth and continuous transition from the top of the toe cap to the bottom of the front outer sole, thereby enabling an infant or child to drag the toe portion of the shole without stumbling or tripping on a protuberance in the transition region.

55 Claims, 4 Drawing Sheets

SPLIT-SOLE SHOE WITH A COMBINED TOE CAP AND FRONT OUTER SOLE

BACKGROUND OF THE INVENTION

The present invention relates generally to shoes, and more particularly to shoes to accommodate the walking habits of infants and children.

Typically, an infant faced with the difficulties of learning to walk bears additional hardships when trying to adapt to wearing shoes or sneakers, particularly when the shoes or sneakers are new. The soles of a new pair of shoes or sneakers are relatively stiff by virtue of the material of which it is comprised, the material on the inside of the shoe or sneaker, or a combination of both. Thus, an infant must "break-in" the region of the sole which must flex when a normal heel-to-toe step is taken. Most older children, in the years prior to adolescence but after having learned the fundamentals of walking or running, must similarly break-in new shoes or sneakers. During the break-in period, the new shoe or sneaker may cause the infant or child discomfort and often severe pain in day-to-day walking or running activities. In some cases, such discomfort and pain could hinder the normal growth and development of a child's foot, as well as the way in which the child learns to walk or run. For example, a child may tend to move his or her foot to the side rather than heel-to-toe, thus causing the child to drag the medial side portion of the shoe. By the time the shoe is broken in by the child, the child may have already developed such a bad habit or improper form which cannot be easily reversed.

Parents are particularly aware of the time it takes a child to break-in a pair of shoes or sneakers. Many parents will attest that the break-in period is often completed only after the child's foot has outgrown the shoe or sneaker or after the protective and aesthetic functions of the upper have been destroyed. Even if this is not the case, the region of the shoe which flexes while taking a heel-to-toe step does not become highly flexible so as to ease the steps taken by a child.

Infants, and children in their years prior to adolescence, also tend to drag the toe portion of a shoe after taking a step. This dragging action of a foot could occur for several reasons, whether it is before, during or after the break-in period for the sole. Most would attribute this poor habit to improper or lack of education as to proper walking form or generally to laziness of the feet during walking activities. For those children which tend to move their feet to the side while taking a step, the side sections of the toe portion are dragged. Others will drag the front and/or the top sections of the toe portion. The dragging of the toe portion of a shoe may cause the top, front and sides of the toe portion to become scuffed and worn, thereby destroying the protective and aesthetic functions of the toe portion, especially where the upper is made of a canvas or soft leather.

Moreover, the dragging of the toe portion also may cause infants and children to stumble or trip on the toe portion of the shoe. In most every case, it is the specific structure of the toe portion which causes the child to stumble or trip. FIG. 1 of the drawings shows a side view of the toe portion of a prior art shoe. Thus, it can be seen that the sole portion forms a protuberance about the toe portion, thereby yielding an excess of material on which a child will trip as his or her foot is dragged. FIG. 2 shows the manner in which a prior art shoe is dragged by many children. Such a manner of walking may at first appear to be unusual, however, parents can attest to the scuffed and worn portions of a toe cap which is evidence that such dragging steps are in fact taken. Careful observation reveals that such tripping often occurs as a result of the child dragging the toe portion of the shoe from the upper (often made of a smooth leather) to the protruding periphery of the sole portion. The child will effortlessly drag his or her feet along the smooth contour of the toe cap but will encounter problems when the protuberance about the periphery of the toe portion engages the ground thereby tripping the child. Thus, one specific cause of a child tripping while dragging their feet is the discontinuous transition from the upper to the sole of the shoe.

In an attempt to alleviate the above shortcomings associated with breaking in the sole of a shoe, those in the industry have provided relief grooves in the bottom of the sole portion of a shoe or sneaker. Such relief grooves extend transversely from the lateral side of the shoe to the medial side of the shoe in the region which flexes while taking a step, and are relatively narrow in width and shallow in depth. Relief grooves are primarily employed on sneakers or other recreational shoes since such grooves can be integrated with the bottom design of the sneaker or other recreational shoe, which bottom design is typically provided for aesthetic value as well as for providing traction. Moreover, sneakers are economically susceptible to the provision of such relief grooves since they are easily formed in the rubber or plastic of which sneakers are normally made. It is more difficult to incorporate the relief groove concept into shoes other than those having rubber or plastic soles.

While relief grooves provide some increased flexibility in the region of concern, the degree to which the flexibility can be increased is limited by the type of material used, the width of the groove and the thickness of the sole. The flexure region of a shoe, that is, the region which creases while taking a step, will almost invariably be wider than such relief grooves. Thus, the degree to which such relief grooves ease the steps taken by a child is substantially lessened. Moreover, the flexure region of a shoe will vary in width and location depending, inter alia, on the walking habits of each individual child and the type of activities engaged in while wearing the shoes.

The foot dragging problem discussed above has not been addressed by the shoe industry to the same degree as the flexure problem. It appears as though all aspects of the foot dragging problem have not even been recognized by those in the shoe industry. Toe caps made of thermoplastics are well-known and, by virtue of the characteristics attributed to thermoplastics, alleviate the problem of accelerated wear and tear on the toe portion of the upper as imparted thereon by children while dragging their feet. However, such thermoplastic toe caps do not prevent children from stumbling or tripping when dragging their feet since the toe cap is formed as part of the upper which is fastened to the periphery of the sole portion. This results in the same discontinuous transition from the upper to the bottom surface of the sole portion. The protuberance about the periphery of the toe portion of the shoe remains for the infant or child to stumble on when it engages the ground.

The above shortcomings make it apparent that significant improvements which would facilitate the education of infants and children as to the proper form of walking and running are warranted. It is imperative to note that several adolescents and adults, particularly those having various diseases relating to the control of the muscular or nervous system, or those with certain orthopedic disorders, also experience the foregoing problems with footwear. Thus, although the present invention will find its purposes to be furthered primarily with respect to footwear for infants and children, it is directed at footwear in general.

SUMMARY OF THE INVENTION

The present invention specifically relates to a split-sole shoe having a front outer sole which covers the bottom of the toes and a substantial portion of the sole of a foot and a heel member for covering the heel and intermediate region of the foot, wherein said front outer sole includes an outwardly facing exterior recessed section having a secondary bottom surface and said heel member includes an inwardly facing interior recessed section having a secondary interior surface, a substantial portion of said secondary interior surface being connected to a substantial portion of said secondary bottom surface in an overlapping configuration, thereby joining said heel member to said front outer sole and providing an exterior relief groove between the edge of said interior recessed section and the recess wall of said bottom recessed section and an interior relief groove between the edge of said bottom recessed section and the recess wall of said interior recessed section. These relief grooves and the overlapping configuration of the respective recessed sections provide increased flexibility in the region of the shoe which flexes while taking a step. The front outer sole portion of the present invention is formed integrally with a toe cap portion which covers the front, sides and top of the toes of a foot, wherein the toe cap portion includes lateral and medial side sections and a front section, all of which are integral with the front outer sole at the periphery thereof. There is a substantially smooth and continuous transition from the toe cap portion to the front outer sole which effectively serves to lessen the likelihood of an infant or child tripping as a result of dragging the toe portion of a shoe while walking.

Accordingly, it is an object of the present invention to provide a shoe having a split-sole which provides increased flexibility in the region of the sole which flexes while taking a step.

It is another object of the present invention to provide a combined toe cap and front outer sole for use in connection with a split-sole shoe which lessens the likelihood of an infant or child tripping on the toe portion of the shoe.

BRIEF DESCRIPTION OF THE DRAWINGS

The above and other objects of the present invention will become apparent, as will a better understanding of the concepts underlying the present invention, by reference to the description which follows when taken in conjunction with the accompanying drawings in which.

DETAILED DESCRIPTION

Figure 1:
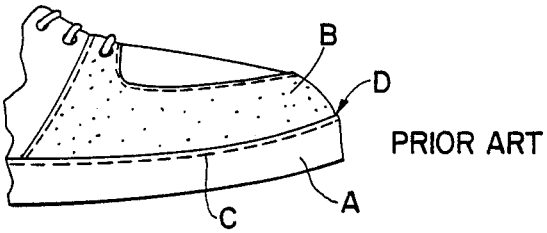
FIG. 1 is a partial right side elevational view of a prior art shoe, illustrating the discontinuous transition from the top of the toe portion to the bottom of the front outer sole.
Figure 2:
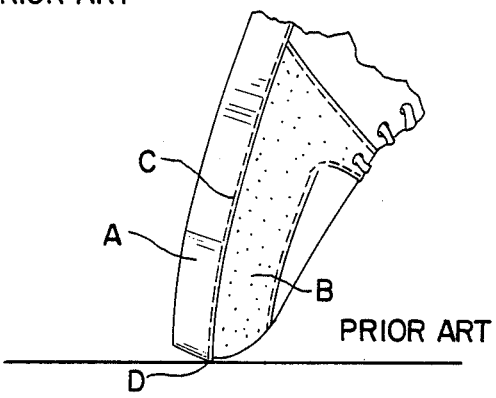
FIG. 2 is a partial side view of the prior art shoe shown in FIG. 1 illustrating the manner in which infants or children tend to drag their feet and ultimately trip on the protuberance in the transition region.
Figure 13:
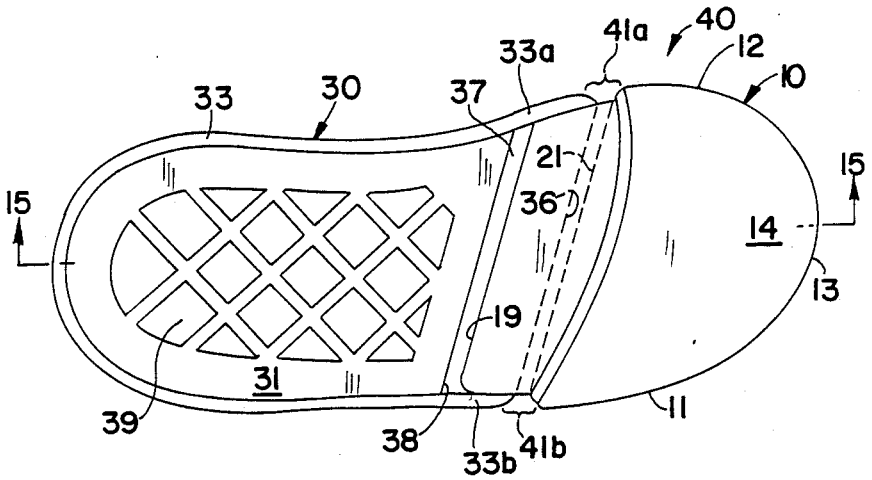
FIG. 13 is a top view of the sole of a shoe which is comprised of the combined toe cap and front outer sole shown in FIG. 3 connected to the heel member shown in FIG. 8.
Figure 14:
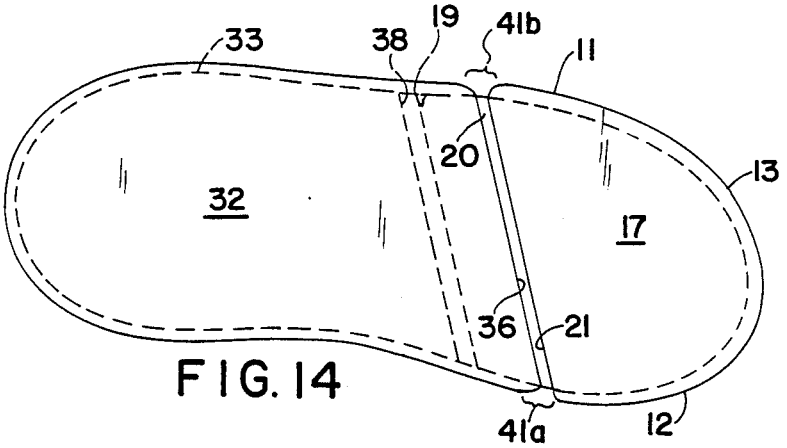
FIG. 14 is a bottom plan view of the sole shown in FIG. 13.
Figure 12:
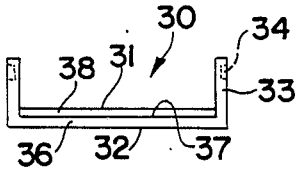
FIG. 12 is a front view of the heel member shown in FIG. 8, illustrating in particular the relationship between the interior recessed section and the peripheral walls.
Figure 18:
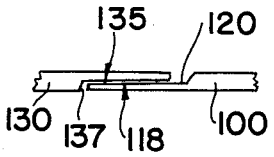
FIG. 18 is a partial cross section of the connected recessed sections of a split-sole shoe in accordance with an alternate embodiment of the present invention.
Figure 15:
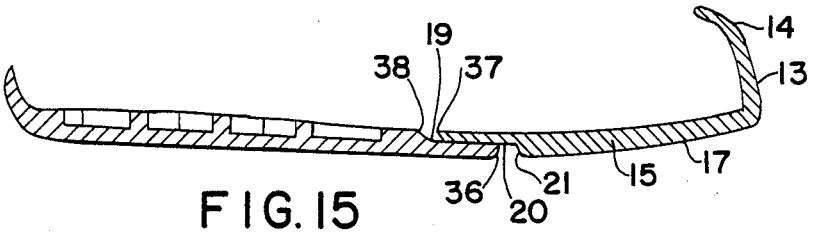
FIG. 15 is a longitudinal sectional view of the sole taken on line 15 in FIG. 13.
Figure 16:
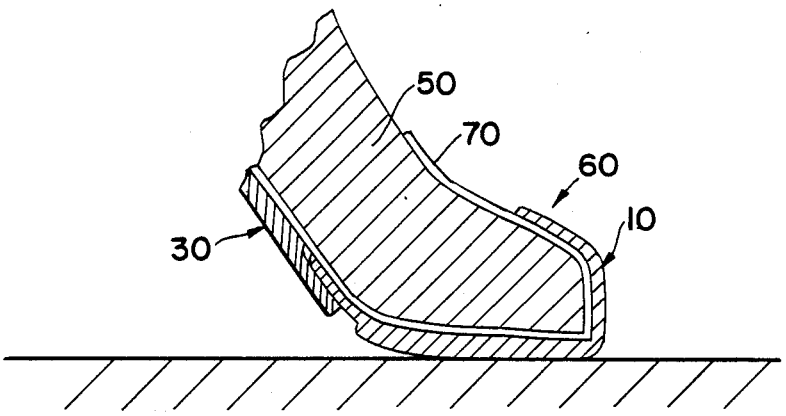
FIG. 16 is a partial sectional view of a shoe made in accordance with the present invention, illustrating in particular the increased flexure in the region of the connected recessed sections.
Figure 17:
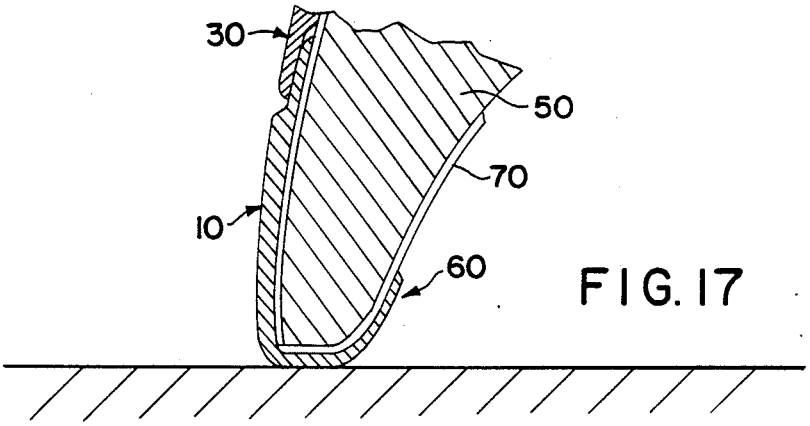
FIG. 17 is a partial sectional view of a shoe made in accordance with the present invention, illustrating in particular the dragging of the smooth and continuous transition region from the toe cap to the front outer sole.

Referring to the Figures, FIGS. 3–7 show a combined toe cap and front outer sole generally designated as 10; FIGS. 8–12 show a heel member generally designated as 30; and FIGS. 13–15 show the sole of a split-sole shoe generally designated as 40, all in accordance with the present invention. FIGS. 16 and 17 show the improved functionality of a shoe constructed in accordance with the present invention, as compared to the typical prior art shoe shown in FIGS. 1 and 2, and FIG. 18 shows an alternate embodiment of the sole of a split-sole shoe. Both the combined toe cap and front outer sole 10 and the heel member 30 are preferably made from a thermoplastic rubber although a plurality of different materials are suitable for use in connection with the present invention since it is primarily the structure which imparts the foregoing advantages and benefits to a shoe.

Thus, FIGS. I and 2 show the typical prior art shoe which is comprised of a sole portion A and an upper B which is fastened, by stitches C, to the periphery of sole A. This effectively forms a protuberant region D about the toe portion of the prior art shoe. It is this protuberant region D which eventually engages the ground, as shown in FIG. 2, when an infant or child drags the toe portion of the prior art shoe.

The structure of the combined toe cap and front outer sole 10 eliminates the protuberant region which heretofore was prominent on the toe portions of shoes and sneakers. A lateral side section 11, a medial side section 12, a front section 13 and a top section 14 define the toe cap portion of the combined toe cap and front outer sole 10. The lateral side section 11, medial side section 12, front section 13 and top section 14 surround, respectively, the sides, front and top of the toes of a foot. Of course, the top section 14 of the toe cap portion need only extend rearwardly a distance sufficient to cover the top of the toes. In this context, any configuration consistent with such a construction can be employed. This includes any designs which might be desirable for the top section of the toe cap portion or the provision of eyelets in the top section so as to enable the upper of a shoe to be lacedly connected to the toe cap portion of the combined toe cap and front outer sole 10.

Figure 5:
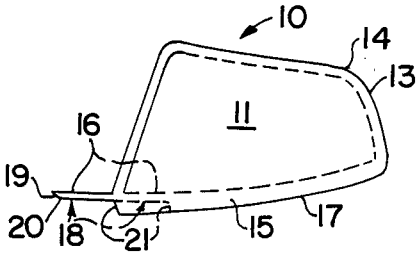
FIG. 5 is a right side elevational view of the combined toe cap and front outer sole shown in FIG. 3, showing the lateral side section of the toe cap and the recessed section of the front outer sole.
Figure 6:
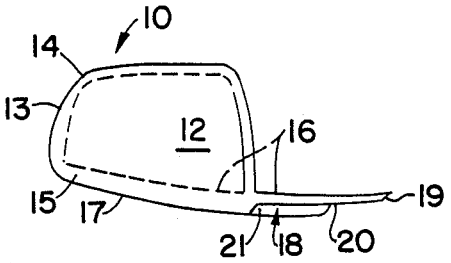
FIG. 6 is a left side elevational view of the combined toe cap and front outer sole shown in FIG. 3, showing the medial side of the toe cap and the recessed section of the front outer sole.
Figure 7:
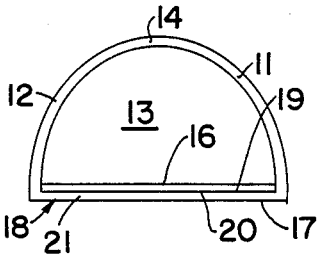
FIG. 7 is a rear view of the combined toe cap and front out sole shown in FIG. 3, illustrating in particular the hollow region defined by the front outer sole and the sides, front and top of the toe cap.
Figure 8:
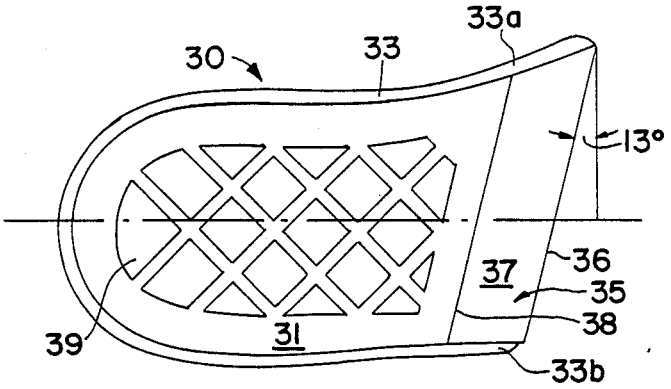
FIG. 8 is a top plan view of a heel member in accordance with the present invention, showing the interior side of said heel member.
Figure 9:
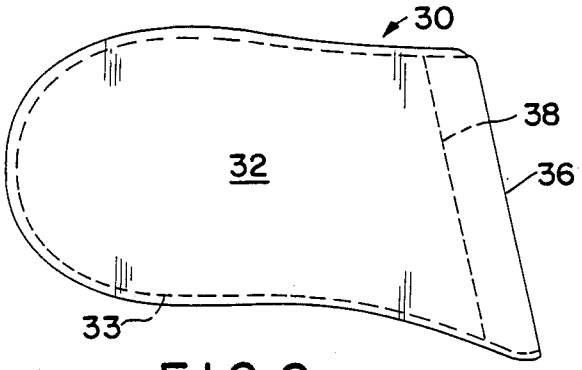
FIG. 9 is a bottom plan view of the heel member shown in FIG. 8.

Integrally connected to the above-described sections of the toe cap portion is an outer sole 15. The outer sole 15 includes an interior surface 16 and a bottom surface 17. The outer sole 15 extends rearwardly beyond the lateral side section 11 and the medial side section 12. As best shown in FIGS. 5 and 6, outer sole 15 includes an exterior recessed section 18 which extends from the medial side to the lateral side of the combined toe cap and front outer sole 10. The exterior recessed section 18 is strategically located on the outer sole 15 so that when a foot is inserted into a shoe constructed with the combined toe cap and front outer sole 10, the exterior recessed section 18 lies beneath the region of the foot which bends while taking a heel-to-toe step. This region is normally located at the rearward portion of the sole of the foot and the transition region from the sole of the foot to the intermediate portion of the foot. As discussed in the Background of the Invention, the region of concern in this instance varies from foot to foot and on the activities engaged in while wearing the shoes. Thus, exterior recessed section 18 has a predetermined width so as to accommodate most, if not all, such bending regions on the feet of different infants and children.

The exterior recessed section 18 includes an edge 19, a secondary bottom surface 20 and a wall 21, wherein the wall 21 connects bottom surface 17 with secondary bottom surface 20 and the secondary bottom surface 20 is substantially parallel to the bottom surface 17 of the outer sole 15.

Figure 3:
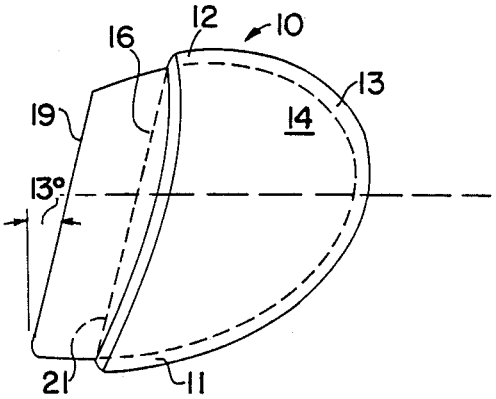
FIG. 3 is a top plan view of a combined toe cap and front outer sole in accordance with the present invention.
Figure 4:
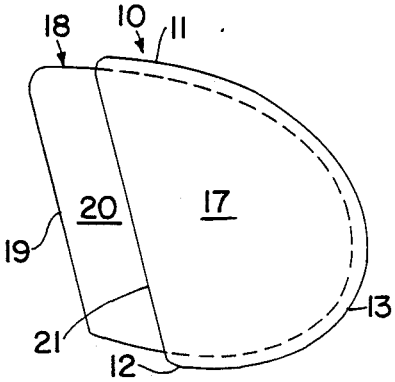
FIG. 4 is a bottom plan view of the combined toe cap and front outer sole shown in FIG. 3.

It is important to note that the exterior recessed section 18 is configured so as to extend in a rearward direction from the medial side to the lateral side of the combined toe cap and front outer sole 10. This configuration better approximates the bending of a foot in the region of concern. It has been found that the optimum angle of such rearward extension is approximately 13°, as taken from an imaginary line which is parallel to an imaginary tangent line drawn through the central point on front section 13 of the combined toe cap and front outer sole 10. As shown in FIG. 3, the imaginary line from which the 13° is measured would be substantially perpendicular to the longitudinal axis of the combined toe cap and front outer sole 10, said longitudinal axis being shown in phantom in FIG. 3. This imaginary line should also be substantially perpendicular to an imaginary tangent line drawn through the point at which the exterior recessed section intersects the lateral side section 11 of the combined toe cap and front outer sole 10.

The exterior recessed section 18 is provided for communication with a heel member, described below, so as to provide increased flexibility at the region of connection, thereby easing the steps taken by an infant or child. The cooperation between the elements of the exterior recessed section 18 and the similar elements of a recessed section in a heel member is described in detail below.

One skilled in the art will readily recognize that the combined toe cap and front outer sole 10 described above provides for a smooth transition from the toe cap portion to the outer sole portion. FIGS. 3 and 5–7 illustrate this smooth transition from the side sections and front section to the outer sole. There is no protuberance about the periphery of the toe portion which could engage the ground as an infant or child drags the toe portion. FIG. 17 illustrates the dragging of the toe portion of a shoe which includes a combined toe cap and front outer sole constructed as described above. A comparison of FIG. 17 with FIG. 2, showing the prior art shoe, reveals that there is no protuberance on which an infant or child can stumble or trip. The smooth transition from the toe portion to the outer sole enables the infant or child to effortlessly drag the lateral side section 11, medial side section 12, front section 13 and top section 14 along the ground until the bottom surface 17 of outer sole 15 is reached at which time the infant or child takes another step. Thus, the smooth and continuous transition from the toe cap to the outer sole serves to prevent an infant or child from tripping when dragging his or her feet.

FIGS. 8–12 show a heel member 30 for matable engagement with the combined toe cap and front outer sole 10 described above. Thus, the heel member 30 is adapted to cover the intermediate portion of a foot and the bottom of the heel of a foot. In conjunction with the combined toe cap and front outer sole 10, the heel member 30 provides the increased flexibility in the region of the shoe which must flex while taking a heel-to-toe step.

Figure 10:
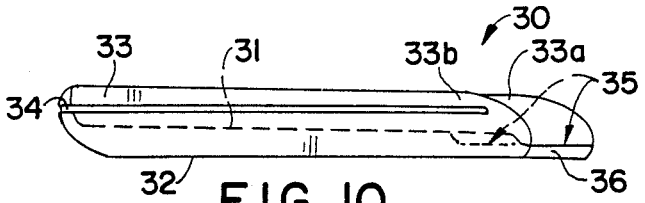
FIG. 10 is a right side elevational view of the heel member shown in FIG. 8, showing the lateral side of said heel member.
Figure 11:
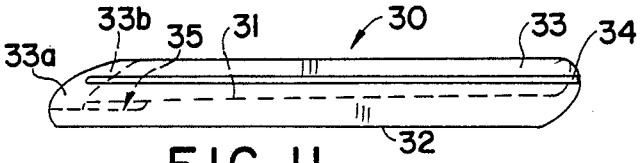
FIG. 11 is a left side elevational view of the heel member shown in FIG. 8, showing the medial side of said heel member.

The heel member 30 includes an interior surface 31, a bottom surface 32 and a peripheral wall portion 33 extending about and upwardly from the interior surface 31. In conventional prior art shoes, this peripheral wall would extend beyond the heel member and about any front outer sole portion to which the heel member is integrally connected. It is, therefore, this peripheral wall which provided the step-hindering protuberance about the toe portion of the conventional prior art shoe. In the present invention, the peripheral wall 33 meets with the medial and lateral side sections of the combined toe cap and front outer sole 10. The peripheral wall 33 includes a stitch groove 34, as shown in FIGS. 10 and 11, for fastening an upper to the heel member 30. The waffle-like pattern 39 shown on the heel member 30 is just one of a number of well-known structures for providing additional cushioning in the heel region of a shoe. Of course, any well-known structure can be employed in conjunction with the present invention.

To facilitate the mating engagement of the heel member 30 to the combined toe cap and front outer sole 10, the heel member 30 includes an interior recessed section 35 which extends rearwardly, at the same angle as the exterior recessed section 18 of the combined toe cap and front outer sole 10, from the medial side to the lateral side of the heel member 30. Again, the optimum angle of rearward extension has been found to be 13° as measured from an imaginary line which is perpendicular to the longitudinal axis of the heel member 30, said longitudinal axis being shown in phantom in FIG. 8. The interior recessed section 35 includes an edge 36, secondary interior surface 37 and a wall 38, the wall 38 connecting interior surface 31 with secondary interior surface 37. It is important to note that the peripheral wall 33 extends along the sides of the interior recessed section 35 and upwardly from the secondary interior surface 37 of the interior recessed section 35. Thus, the width of exterior recessed section 18 of the combined toe cap and front outer sole 10 is sized to fit between peripheral wall portion **33*a* on the medial side of heel member 30 and the peripheral wall portion 33*b* on the lateral side of the heel member 30**.

FIGS. 13–15 show a shoe sole 40 which is comprised of the combined toe cap and front outer sole 10 and the heel member 30. The combined toe cap and front outer sole 10 is joined with the heel member 30 by overlapping a substantial portion of exterior recessed section 18 over a substantial portion of interior recessed section 35 so that secondary bottom surface 20 is in contact with secondary interior surface 37. A neoprene cement or any other suitable fastening means can be utilized to fasten the thermoplastic rubber of which the respective recessed sections are made. Once the respective recessed sections are joined in this manner, the interior surface 16 of the combined toe cap and front outer sole 10 will be substantially flush with the interior surface 31 of the heel member 30, and the bottom surface 17 of the combined toe cap and front outer sole 10 will be substantially flush with the bottom surface 32 of the heel member 30. Thus, sole inserts or other material may be placed on the interior of the shoe sole 40 for disposition between a foot and the shoe sole 40.

It is particularly noted that edge 19 does not abut wall 38 on the interior side of the shoe sole 40 and edge 36 does not abut wall 21 on the exterior side of the shoe sole 40. Thus, an interior relief groove is defined by edge 19, secondary interior surface 37 and wall 38, and an exterior relief groove is defined by edge 36, secondary bottom surface 20 and wall 21. Another important feature is that of gap **41*a* and gap 41*b*, gap 41*a* residing between peripheral wall 33*a* and medial side section 12 and gap 41*b* residing between peripheral wall 33*b* and lateral side section as shown in FIG. 13**.

Thus, the above construction provides increased flexibility in the region surrounding the connection of the respective recessed sections. The joining of the two relatively thin recessed sections inherently provides increased flexibility in the region of connection. This increased flexibility is augmented by the provision of the interior relief groove and the exterior relief groove, both of which are established by spacing the edges of the respective recessed sections from the walls of the respective recessed sections. The gaps **41*a* and 41*b*** also serve to augment the flexibility in the region of concern.

One skilled in the art will recognize that the aggregation of these flexibility-inducing elements not only enhance the flexibility in the region of concern, but also widen the flexible region itself. In effect, a flexible hinge-like structure is created when the combined toe cap and front outer sole 10 is connected to the heel member 30.

FIG. 16 shows a partial cross section of a foot 50, in a shoe 60 made from shoe sole 40 and a lasted upper 70, as a step is being taken. Although the ease with which the shoe 60 flexes in the region of connection between the combined toe cap and front outer sole 10 and heel member 30 cannot easily be shown in a drawing, FIG. 16 shows the degree of flexure while taking a heel-to-toe step. Thus, it can be seen that the flexibility imparted to the shoe 60 by the overlapping of the respective recessed sections is greatly improved as compared to the conventional prior art shoe.

FIG. 18 shows a partial cross section of the connected recess sections of the sole of a split-sole made in accordance with another embodiment of the present invention. This alternate structure merely shows the respective recessed sections being reversed. Thus, the combined toe cap and front outer sole 100 has an inwardly facing recessed section 118 to form a secondary interior surface 120 and the heel member 130 has an outwardly facing recessed section 135 to form a secondary bottom surface 137. The combined toe cap and front outer sole 100 is connected to the heel member 130 in the same manner as described above. An interior relief groove and an exterior relief groove will also be formed as described above. While the first embodiment described above is preferred because there is less likelihood that the interior relief groove will pinch the rearward portion of the sole of a foot, the alternate arrangement shown in FIG. 18 is functionally equivalent.

Accordingly, an infant or child need not undergo the discomfort of breaking in a new pair of shoes or sneakers. A shoe constructed in this manner will also facilitate the proper growth and development of the infant's or child's foot since the foot will not be restricted in any way and the infant or child will tend to walk more naturally—as if in bare feet. Thus, educating an infant or child as to the proper form of walking or running becomes an easier task since parents or other instructors will be assured of a properly fitting and easily manipulated shoe. In addition to the increased flexibility to ease the steps taken by an infant or child, the child will no longer encounter the problem of stumbling or tripping since there exists no protuberance on which to stumble or trip. Further, since the combined toe cap and front outer sole 10 can be made from a thermoplastic rubber, a substantially scuff-resistant material, parents need not concern themselves with the aesthetic appearance of the infant's or child's shoe or the premature destruction of the toe portion by reason of the infant or child dragging their feet.

While the foregoing description and figure illustrate one preferred embodiment of the split sole shoe with a combined toe cap and front outer sole in accordance with the present invention, it should be appreciated that certain modifications may be made in the structure, material and functional aspects of the disclosed embodiment without departing from the spirit and scope of the present invention which is defined by the claims which are set forth immediately hereafter.

What is claimed is:

1. A combined toe cap and front outer sole for use as part of a walking shoe, said combined toe cap and front outer sole comprising a member including a toe cap portion for covering the front, sides and top of the toes of a foot, and an outer sole portion for covering the bottom of the toes and at least a substantial portion of the sole of a foot, said toe cap portion including a lateral side section, a medial side section, a front section and a top section, said outer sole portion extending rearwardly from said front section and being connected to said medial side section and to said lateral side section, said combined toe cap and front outer sole being constructed and arranged for connection to the heel member and upper of a walking shoe, there being a substantially smooth and continuous transition from said top section to said front section and from said front section to said outer sole portion.

2. The combined toe cap and front outer sole claimed in claim 1, wherein a substantially smooth and continuous transition is also provided from said medial and lateral side sections to said outer sole portion.

3. The combined toe cap and front outer sole claimed in claim 2, wherein said toe cap portion is constructed so as to provide a hollow region between said outer sole portion, said lateral and medial side sections and said front section, said hollow region being adapted to receive the front, sides, and top of the toes of a foot, thereby enabling a foot to be inserted thereinto without forcing any section of the toe cap portion into position about the foot.

4. The combined toe cap and front outer sole claimed in claim 2, wherein said member has a generally cupped-shaped configuration with a hollow region adapted to receive the front, sides, and top of the toes of a foot, thereby enabling a foot to be inserted thereinto without forcing any section of the toe cap portion into position about the foot.

5. The combined toe cap and front outer sole claimed in claim 2, wherein said member is made of a thermoplastic.

6. The combined toe cap and front outer sole claimed in claim 2, wherein said toe cap portion is made of a thermoplastic rubber.

7. The combined toe cap and front outer sole claimed in claim 2, wherein said outer sole portion includes a recessed section, said recessed section extending transversely across the rear portion of said outer sole portion, said recessed section being adapted for connection to the heel member of a shoe so as to provide increased flexibility in the region of said recessed section.

8. The combined toe cap and front outer sole claimed in claim 7, wherein at least a portion of said recessed section extends rearwardly beyond said lateral and medial side sections.

9. The combined toe cap and front outer sole claimed in claim 7, wherein said recessed section is located rearward of said lateral and medial side sections.

10. The combined toe cap and front outer sole claimed in claim 7, wherein said recessed section has a thickness which is substantially less than the thickness of the remaining section of the outer sole portion, thereby increasing the flexibility in the region of said recessed section where said recessed section is connected to a heel member.

11. The combined toe cap and front outer sole claimed in claim 7, wherein said recessed section extends rearwardly from said medial side section to said lateral side section.

12. The combined toe cap and front outer sole claimed in claim 7, wherein said recessed section extends rearwardly from said medial side section to said lateral side section at an angle of approximately 13 degrees from an imaginary line which is perpendicular to an imaginary tangent line drawn through the point at which the recessed section intersects said lateral side section.

13. The combined toe cap and front outer sole in claim 1, wherein said member is a single integrally molded piece.

14. A heel member for a split-sole shoe, said heel member comprising a member having a rear side, a lateral side, a medial side, and a sole section connecting said rear, lateral and medial sides for covering the bottom heel and intermediate portion of a foot, a peripheral wall section extending upwardly from said rear, lateral and medial sides, said sole section including a recessed section extending transversely from said medial side to said lateral side at the side remote from said rear side, said recessed section having a lateral side peripheral wall extending upwardly from its lateral side and a medial side peripheral wall extending upwardly from its medial side, and said recessed section being adapted for connection to the front outer sole of a split-sole shoe sized to provide increased flexibility in the region of said recessed section.

15. The heel member claimed in claim 14, wherein said sole section includes an interior surface, and said recessed section is formed in said interior surface so as to define a secondary interior surface below the plane of said interior surface.

16. The heel member claimed in claim 15, wherein said recessed section has a thickness which is substantially less than the thickness of the remaining section of the sole section, thereby increasing the flexibility in the region of said recessed section when said recessed section is connected to the front outer sole of a split-sole shoe.

17. The heel member claimed in claim 15, wherein said recessed section extends rearwardly from said medial side to said lateral side.

18. The heel member claimed in claim 15, wherein said recessed section extends rearwardly from said medial side to said lateral side at an angle of approximately 13 degrees from an imaginary line which is perpendicular to an imaginary tangent line drawn through the point at which the recessed section intersects said medial side.

19. The heel member claimed in claim 15, wherein said member is made of a thermoplastic rubber.

20. A shoe comprising:

(a) a combined toe cap and front outer sole having a toe cap portion for covering the front, sides and top of the toes of a foot, and an outer sole portion for covering the bottom of the toes and at least a substantial portion of the sole of a foot, said toe cap portion including a lateral side section, a medial side section, a front section and a top section, said outer sole portion extending rearwardly from said front section and being connected to said medial side section and said lateral side section to thereby provide a substantially smooth and continuous transition from said top section to said front section, from said front section to said outer sole portion, and from said medial and lateral side sections to said outer sole portion, said outer sole portion including a first recessed section extending transversely across the end of said outer sole portion which is remote from said front section; and (b) a heel member connected to said combined toe cap and front outer sole for covering the bottom heel and intermediate region of a foot, said heel member having a rear side, a lateral side, a medial side, and a sole section being connected to said rear, lateral and medial sides, said sole section including a second recessed section extending transversely across the side remote from said rear side, and said second recessed section of said sole section being connected to said first recessed section of said combined toe cap and front outer sole to thereby provide increased flexibility in the region of the connected recessed sections.

21. The shoe claimed in claim 20, wherein said combined toe cap and front outer sole has a bottom surface and said first recessed section is provided on said bottom surface to define a secondary bottom surface, and said heel member has an interior surface and said second recessed section is provided on said interior surface to define a secondary interior surface, a substantial portion of said secondary interior surface being connected to a substantial portion of said secondary bottom surface.

22. The shoe claimed in claim 21, wherein an interior relief groove is formed between said first recessed section of said combined toe cap and front outer sole and said interior surface of said heel member whereby said secondary interior surface forms the bottom of said interior relief groove.

23. The shoe claimed in claim 21, wherein an exterior relief groove is formed between said second recessed section of said heel member and said bottom surface of said combined toe cap and front outer sole, whereby said secondary bottom surface forms the bottom of said exterior relief groove.

24. The shoe claimed in claim 22 wherein an exterior relief groove is formed between said second recessed section of said heel member and said bottom surface of said combined toe cap and front outer sole, whereby said secondary bottom surface forms the bottom of said exterior relief groove.

25. The shoe claimed in claim 21, wherein said heel member includes a peripheral wall extending upwardly from said rear, lateral and medial sides.

26. The shoe claimed in claim 25, wherein a medial relief gap is provided between the portion of said peripheral wall extending upwardly from said medial side and the medial side section of said combined toe cap and front outer sole, and a lateral relief gap is provided between the portion of said peripheral wall extending upwardly from said lateral side and said lateral side section of said combined toe cap and front outer sole, said medial relief gap and said lateral relief gap being located in the region of the connected recessed sections to further enhance the flexibility in said region.

27. The shoe claimed in claim 21, wherein said combined toe cap and front outer sole and said heel member are made of a thermoplastic rubber.

28. The shoe claimed in claim 21, wherein said first recessed section and said second recessed section extend rearwardly from the medial side to the lateral side of said shoe sole.

29. The shoe claimed in claim 21, wherein said first recessed section and said second recessed section extend rearwardly from the medial side to the lateral side of said shoe sole at an angle of approximately 13 degrees from an imaginary line which is perpendicular to an imaginary tangent line drawn through the point at which the first recessed section intersects the lateral side section.

30. A combined toe cap and front outer sole for a shoe, said combined toe cap and front outer sole comprising a member including a toe cap portion for covering the front, sides and top of the toes of a foot, and an outer sole portion for covering the bottom of the toes and at least a substantial portion of the sole of a foot, said toe cap portion including a lateral side section, a medial side section, a front section and a top section, said outer sole portion extending rearwardly from said front section and being connected to said medial side section and to said lateral side section, said outer sole portion having a bottom surface and a recessed section, said recessed section having a secondary bottom surface and extending transversely across the end of said outer sole portion which is remote from said front section, said secondary bottom surface of said recessed section being adapted for connection to the heel member of a shoe so as to provide increased flexibility in the region of said recessed section, there being a substantially smooth and continuous transition from said top section to said front section, from front section to said outer sole portion and from said medial and lateral side sections to said outer sole portion.

31. The combined toe cap and front outer sole claimed in claim 30, wherein at least a portion of said recessed section of said outer sole portion extends rearwardly beyond said lateral and medial side sections.

32. The combined toe cap and front outer sole claimed in claim 30, wherein said recessed section of said outer sole portion is located rearward of said lateral and medial side sections.

33. The combined toe cap and front outer sole claimed in claim 30, wherein said recessed section of said outer sole portion has a thickness which is substantially less than the thickness of the remaining section of the outer sole portion, thereby increasing the flexibility in the region of said recessed section when said recessed section is connected to a heel member.

34. The combined toe cap and front outer sole claimed in claim 30, wherein said recessed section extends rearwardly from said medial side section to said lateral side section.

35. The combined toe cap and front outer sole claimed in claim 30, wherein said recessed section extends rearwardly from said medial side section to said lateral side section at an angle of approximately 13 degrees from an imaginary line which is perpendicular to an imaginary tangent line drawn through the point at which the recessed section intersects said lateral side section.

36. A child's shoe for the early development stages of walking, said shoe comprising:

a. a combined toe cap and front outer sole having a toe cap portion for covering the front, sides and top of the toes of a foot, and an outer sole portion for covering the bottom of the toes and at least a substantial portion of the sole of a foot, said toe cap portion including a lateral side section, a medial side section, a front section and a top section, said outer sole portion extending rearwardly from said front section and being connected to said medial side section and to said lateral side section, there being a substantially smooth and continuous transition from said top section to said front section, from said front section to said outer sole portion and from said medial and lateral side sections to said outer sole portion;

b. a heel member connected to said combined toe cap and front outer sole for covering the bottom heel and intermediate region of a foot, said heel member having a rear side, a lateral side, a medial side, and a sole section being connected to said rear, lateral and medial sides; and c. an upper connected to said combined toe cap and front outer sole and said heel member for covering the top, rear, and said lateral and medial sides of a foot.

37. The shoe in claim 36, wherein said member is a single integrally molded piece.

38. The shoe in claim 36, wherein said combined toe cap and front outer sole is made from a different material from said heel member.

39. A combined toe cap and front outer sole for a shoe, said combined toe cap and front outer sole comprising a member including a toe cap portion for covering the front, sides and top of the toes of a foot, and an outer sole portion for covering the bottom of the toes and at least a substantial portion of the sole of a foot, said toe cap portion including a lateral side section, a medial side section, a front section and a top section, said outer sole portion extending rearwardly from said front section and being connected to said medial side section and to said lateral side section, said outer sole portion having a bottom surface and a recessed section, said recessed section having a secondary bottom surface and extending transversely across the end of said outer sole portion which is remote from said front section, said secondary bottom surface of said recessed section being adapted for connection to the heel member of a shoe so as to provide increased flexibility in the region of said recessed section.

40. The combined toe cap and front outer sole claimed in claim 39, wherein at least a portion of said recessed section of said outer sole portion extends rearwardly beyond said lateral and medial side sections.

41. The combined toe cap and front outer sole in claim 39, wherein said recessed section of said outer sole portion is located rearward of said lateral and medial side sections.

42. The combined toe cap and front outer sole in claim 39, wherein said recessed section of said outer sole portion has a thickness which is substantially less than the thickness of the remaining section of the outer sole portion, thereby increasing the flexibility in the region of said recessed section when said recessed section is connected to a heel member.

43. The combined toe cap and front outer sole in claim 39, wherein said recessed section extends rearwardly from said medial side section to said lateral side section.

44. The combined toe cap and front outer sole in claim 39, wherein said recessed section extends rearwardly from said medial side section to said lateral side section at an angle of approximately 13° from an imaginary line which is perpendicular to an imaginary tangent line drawn through the point at which the recessed section intersects said lateral side section.

45. A shoe comprising:

a. a combined toe cap and front outer sole having a toe cap portion for covering the front, sides and top of the toes of a foot, and an outer sole portion for covering the bottom of the toes and at least a substantial portion of the sole of a foot, said toe cap portion including a lateral side section, a medial side section, a front section and a top section, said outer sole portion extending rearwardly from said front section and being connected to said medial side section and said lateral side section, and said outer sole portion including a first recessed section extending transversely across the end of said outer sole portion which is remote from said front section; and b. a heel member connected to said combined toe cap and front outer sole for covering the bottom heel and intermediate region of a foot, said heel member having a rear side, a lateral side, a medial side, and a sole section being connected to said rear, lateral and medial sides, said sole section including a second recessed section extending transversely across the side remote from said rear side, and said second recessed section of said sole section being connected to said first recessed section of said combined toe cap and front outer sole to thereby provide increased flexibility in the region of the connected recessed sections.

46. The shoe in claim 45, wherein said combined toe cap and front outer sole is made of a different material from said heel member.

47. The shoe claimed in claim 45, wherein said combined toe cap and front outer sole has a bottom surface and said first recessed section is provided on said bottom surface, and said heel member has an interior surface and said second recessed section is provided on said interior surface to define a secondary interior surface, a substantial portion of said secondary interior surface being connected to a substantial portion of said secondary bottom surface.

48. The shoe claimed in claim 47, wherein an interior relief groove is formed between said first recessed section of said combined toe cap and front outer sole and said interior surface of said heel member whereby said secondary interior surface forms the bottom of said interior relief groove.

49. The shoe claimed in claim 47, wherein an exterior relief groove is formed between said second recessed section of said heel member and said bottom surface of said combined toe cap and front outer sole, whereby said secondary bottom surface forms the bottom of said exterior relief groove.

50. The shoe claimed in claim 48, wherein an exterior relief groove is formed between said second recessed section of said heel member and said bottom surface of said combined toe cap and front outer sole, whereby said secondary bottom surface forms the bottom of said exterior relief groove.

51. The shoe claimed in claim 47, wherein said heel member includes a peripheral wall extending upwardly from said rear, lateral and medial sides.

52. The shoe claimed in claim 51, wherein a medial relief gap is provided between the portion of said peripheral wall extending upwardly from said medial side and the medial side section of said combined toe cap and front outer sole, and a lateral relief gap is provided between the portion of said peripheral wall extending upwardly from said lateral side and said lateral side section of said combined toe cap and front outer sole, said medial relief gap and said lateral relief gap being located in the region of the connected recessed sections to further enhance the flexibility in said region.

53. The shoe claimed in claim 47, wherein said combined toe cap and front outer sole and said heel member are made of a thermoplastic rubber.

54. The shoe claimed in claim 47, wherein said first recessed section and said second recessed section extend rearwardly from the medial side to the lateral side of said shoe sole.

55. The shoe claimed in claim 47, wherein said first recessed section of said second recessed section extend rearwardly from the medial side to the lateral side of said shoe sole at an angle of approximately 13 degrees from an imaginary line which is perpendicular to an imaginary tangent line drawn through the point at which the first recessed section intersects the lateral side section.

* * * * *